US006328273B1

(12) United States Patent
Kemikem

(10) Patent No.: US 6,328,273 B1
(45) Date of Patent: Dec. 11, 2001

(54) GROUND-ENGAGING POLE MOUNT FOR SUPPORTING A DEVICE

(76) Inventor: Christopher C. Kemikem, 422 S. Dartmouth, Schaumburg, IL (US) 60193

( * ) Notice: Subject to any disclaimer, the term of this patent is extended or adjusted under 35 U.S.C. 154(b) by 0 days.

(21) Appl. No.: 09/503,425

(22) Filed: Feb. 14, 2000

(51) Int. Cl.[7] ..... F16M 13/00

(52) U.S. Cl. ..... 248/530; 248/156; 248/519; 248/523; 248/121

(58) Field of Search ..... 248/156, 530, 248/519, 521, 532, 523, 121

(56) References Cited

U.S. PATENT DOCUMENTS

| | | | | |
|---|---|---|---|---|
| 1,714,122 | * | 5/1929 | Barks . | |
| 1,736,177 | * | 11/1929 | Snook . | |
| 2,583,210 | * | 1/1952 | Edwards | 250/33.51 |
| 2,945,659 | * | 7/1960 | McDonald | 248/156 |
| 3,318,560 | * | 5/1967 | Garrette et al. | 248/44 |
| 3,579,244 | * | 5/1971 | Dempsey et al. | 343/797 |
| 3,952,523 | * | 4/1976 | Gale | 61/39 |
| 4,492,493 | * | 1/1985 | Webb | 405/172 |
| 4,714,225 | * | 12/1987 | Skinner et al. | 248/523 |
| 4,803,812 | * | 2/1989 | Alexander, Sr. | 52/157 |
| 4,850,564 | * | 7/1989 | Padin | 248/533 |
| 4,923,165 | * | 5/1990 | Cockman | 248/545 |
| 4,928,446 | * | 5/1990 | Alexander, Sr. | 52/98 |
| 5,066,168 | * | 11/1991 | Holdeman | 405/249 |
| 5,303,931 | * | 4/1994 | Brown | 273/348 |
| 5,485,700 | * | 1/1996 | Van Vranken | 52/40 |
| 6,035,576 | * | 5/2000 | Bozeman | 47/47 |
| 6,128,867 | * | 10/2000 | MacKarvich | 52/157 |
| 6,164,613 | * | 12/2000 | Williams | 248/533 |
| 6,189,268 | * | 2/2001 | Carr et al. | 52/36.1 |

* cited by examiner

*Primary Examiner*—Leslie A. Braun
*Assistant Examiner*—Steven Marsh
(74) *Attorney, Agent, or Firm*—Olson & Hierl, Ltd.

(57) ABSTRACT

A pole mount is provided for supporting a device, such as a satellite dish or an antenna. The pole mount includes an elongated rod having a ground penetrating end, and a pair of augers secured on the elongated rod in spaced apart relationship. The first auger, which is closer to the ground penetrating end of the elongated rod, is smaller in diameter than the second auger. The ratio of the diameter of the first auger with respect to the second auger is on the order of three to five. A stabilizing plate is secured to the elongated rod and is constructed and arranged to engage the ground. A support member is secured to the stabilizing plate and extends upwardly therefrom away from the elongated rod. The support member is hollow and is adapted to receive a cable which is provided to connect an appliance, such as a television set, to the satellite dish carried on the support member. The stabilizing plate has a notch or opening through which the cable can conveniently pass and the support member is provided with an opening for the cable. A cover is provided on the support member to protect the cable from the elements.

17 Claims, 1 Drawing Sheet

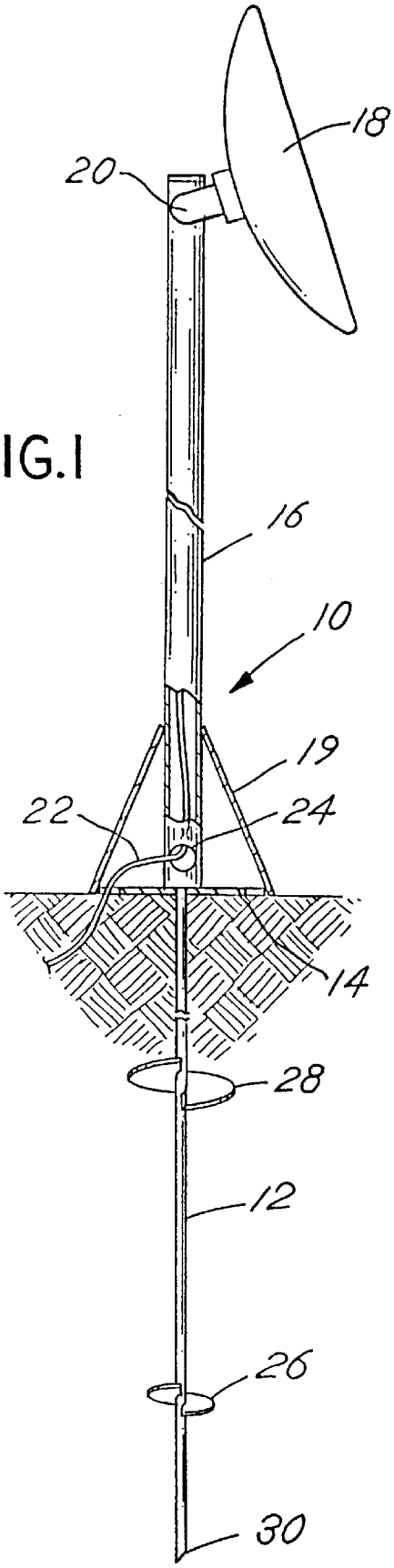
FIG.1
FIG.2
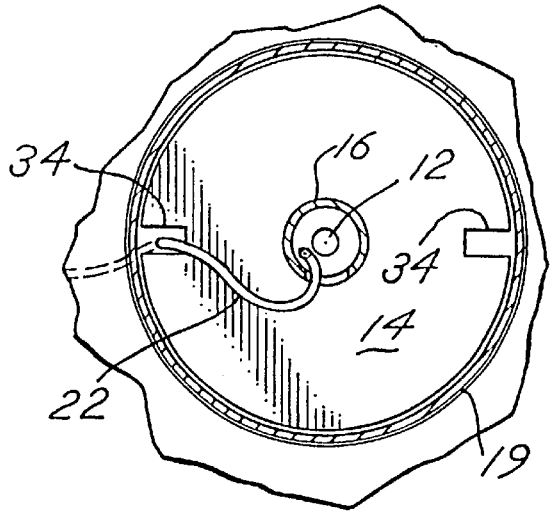
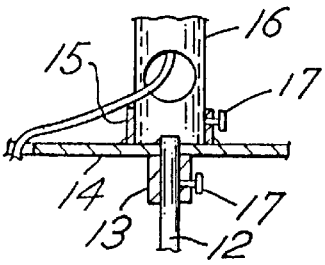
FIG.4
FIG.3
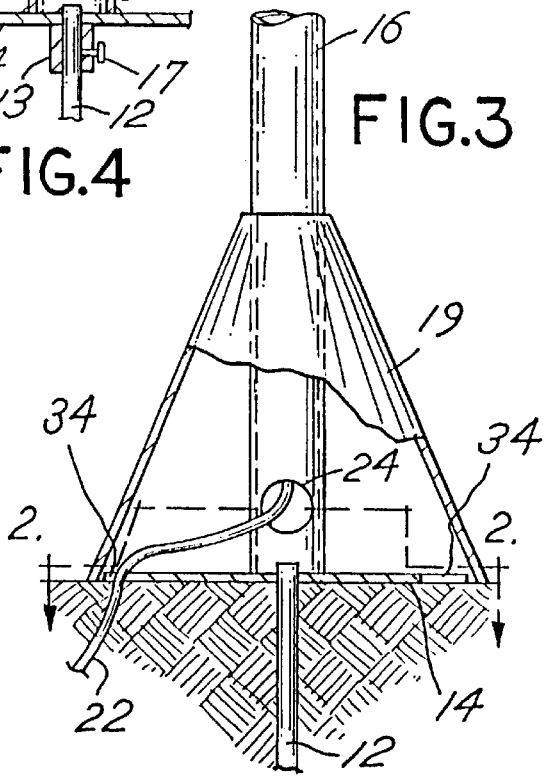

GROUND-ENGAGING POLE MOUNT FOR SUPPORTING A DEVICE

BACKGROUND OF THE INVENTION

This invention pertains to a pole mount for supporting a device, such as a satellite dish, and more particularly, to a pole mount for supporting a device in the ground without cement or any additional stabilizing structure.

One manner of supporting a pole mount in the ground is to dig a hole with a spade shovel to a desired depth, place the pole mount in the hole, and then replace the dirt to hold the pole mount in the upright position. However, it has been found that the dirt will tend to be relatively loose and the pole mount will shift position, particularly if the load or device attached to the pole mount is relatively heavy.

Another manner of supporting a pole mount is to introduce cement into the hole and then to place the pole mount into the cement which will harden and support the pole mount in an upright position. This arrangement necessitates the use of a separate material, cement, which adds to the cost of the installation. There is a time delay between installing the pole and permitting the cement to harden, which in some applications is undesirable.

Among known patents is Dempsey Pat. No. 3,579,244, which shows a pole mount for an antenna that includes a pole having a pointed end for entering the ground, with the pole being supported in position by guy wires. Snook Pat. No. 1,736,177 reveals an umbrella support which includes pointed ground engaging end having a spiral threads formed thereon to facilitate insertion into the ground. Similarly, Padia Pat. No. 4,850,564 discloses an umbrella holder having a ground engaging pointed end with threads on the exterior thereof.

Garrette Pat. No. 3,318,560 pertains to a mast assembly having a ground engaging support that includes a shaft having an auger blade connected to it at the lower end. Cockman Pat. No. 4,953,165 reveals a stabilized post anchor having two auger blades carried near the boring end of the anchor.

An object of the present invention is to provide an improved pole mount for supporting a device in a stable manner in the ground without the need for cement or like material to help support the pole mount.

Another object of the present invention is to provide an improved pole mount having a pair of spaced apart augers thereon, the first auger having a smaller diameter than the second auger in order to facilitate entry of the pole mount into the ground.

Still another object of the present invention is to provide a pole mount having a pair of spaced apart augers thereon cooperating with a stabilizing plate on the pole mount for securely supporting the pole mount in the ground.

A further object of the present invention is to provide a pole mount for a satellite dish or an antenna comprised in part of a tubular pole and a stabilizing plate secured to the lower end thereof, with a pair of spaced apart augers secured to an elongated rod connected to the stabilizing plate and depending therefrom, the stabilizing plate having an opening therein and the tubular pole having a hole therein adjacent the lower end, whereby, a cable can be passed through the opening in the stabilizing plate, through the hole in the tubular pole and connected to the satellite dish or the antenna secured to the pole mount.

Other objects and advantages of the present invention will be made more apparent hereinafter.

SUMMARY OF THE INVENTION

The present invention pertains to a pole mount for supporting a device, such as a satellite dish or an antenna, comprising an elongated rod having a ground penetrating end, a first auger secured to the elongated rod and spaced from the end thereof, a second auger secured to the elongated rod and spaced further from the end then the first auger, the second auger having a larger diameter than the first auger, a stabilizing plate secured adjacent the top of the elongated rod for engaging the ground, a support member secured to the stabilizing plate and extending therefrom in a direction opposed to the elongated rod. In use, the elongated rod is forced into the ground and upon rotation of the elongated rod, the first auger will engage and pull the elongated rod further into the ground and upon further rotation, the second auger will engage and help pull the elongated rod into the ground until the stabilizing plate engages the ground surface, to firmly support the support member in an upright position without the need for any additional support.

BRIEF DESCRIPTION OF THE DRAWING

There is shown in the attached drawing a presently preferred embodiment of the present invention, wherein like numerals in the various views refer to like elements, and wherein:

FIG. 1 is an elevation view illustrating the pole mount of the present invention supported in the ground and carrying a satellite dish thereon;

FIG. 2 is a cross-sectional view through the pole mount, taken generally along the line 2—2 of FIG. 3;

FIG. 3 is an enlarged view of a portion of the pole mount in FIG. 1, better illustrating the cover over the cable entry to the pole mount when it is used to support a satellite dish; and FIG. 4 is a detailed view of a modified pole mount wherein the support member and the elongated rod are detachably secured to the stabilizing plate.

DETAILED DESCRIPTION OF THE PRESENT INVENTION

There is shown in FIG. 1 the pole mount 10 of the present invention. The pole mount 10 comprises an elongated rod 12 secured to a ground-engaging stabilizing plate 14, for example, by welding. Extending upwardly from the stabilizing plate 14, which is generally planar and preferably fabricated from steel, and secured thereto at its lower end is a tubular support member 16. The tubular support member 16 is preferably fabricated from steel tube. Carried on the support member 16 is the device 18 to be supported, which in the illustrated embodiment of the invention, is a satellite dish. Another example of a device to be supported is an antenna. The satellite dish is connected to the support member 16 by a suitable connector 20, as is known in the art. A cover 19, which can be suitably fabricated from plastic or metal, is provided on the support member 16 in order to shield the opening 24 from, for example, snow, rain or animals.

A cable 22 is connected at one end to an appliance, for example, a television set (not shown) and the other end is adapted to be connected to the satellite dish. More particularly, the cable 22 passes from the ground through an opening in the stabilizing plate 14 and then through an opening or hole 24 in the tubular support member 16 and into the tubular support member 16 for connection to the satellite dish.

Secured in spaced relationship to one another on the elongated rod 12 are augers 26 and 28. The first auger 26, which has a smaller diameter than the second auger 28, is spaced proximate to the end 30 of the elongated rod 12. The augers 26 and 28 are preferably fabricated from steel. The end 30 is preferably sharpened or pointed to facilitate entry thereof into the ground. In a presently preferred embodiment of the invention, the first auger 26 and the second auger 28 have diameters in the ratio of three to five. The auger 26 is three inches in diameter and the second auger 28 is five inches in diameter. In one embodiment the elongated rod 12 is approximately 24 inches long. The first auger 26 is spaced about 1¼ inch from the end 30 of the elongated rod 12 and the second auger 28 is spaced about 15 inches from the first auger. The auger 26 readily penetrates the ground and helps to pull the elongated rod 12 into the ground. The second auger 28 follows the path of the first auger 26 and it is easier to rotate the elongated rod 12 in order to firmly anchor the pole mount 10 in the ground. The pole mount 10 is rotated until the stabilizing plate 14 engages the ground. The pole mount 10 is then firmly secured within the ground, without the need for any ancillary supporting structure, such as braces, or cement in a hole. The augers 26 and 28 cooperate to pull the elongated rod 12 into the ground and to firmly anchor the elongated rod 12 and the support member 16 secured thereto in place.

Turning to FIGS. 2 and 3, there is better shown the manner of passing the cable 22 into the tubular member 16. The stabilizing plate 14 is provided with one or more openings or notches 34 for receiving the cable 22. The openings 34 are shown in the periphery of the stabilizing plate 14. This position facilitates passage of the cable 22 from the ground and through the stabilizing plate 14 into the opening 24 in the tubular member 16.

The cover 19 for protecting the opening 24 may be formed of a suitable plastic or of metal. The cover 19 is generally frustro-conical in configuration. The opening in the top of the cover 19 is complementary to the outside diameter of the support member and is adapted to closely engage same to prevent rain and snow from entering between the outside of the support member 16 and the opening in the top of the cover 16. If desired, a separate seal or gasket may be employed between the support member 16 and the cover 19. The lower opening of the cover 19 is a bit larger than the outside diameter or dimension of the stabilizing member 14 so as to entirely extend over same in normal usage. Preferably, the cover 19 extends to the ground over the stabilizing plate 14.

In use, the end 30 of the elongated rod 12 is inserted into the ground in a desired position for the pole mount 10. The pole mount 10 is pushed downwardly until the first auger 26 engages the ground. Then the pole mount 10 is rotated to screw the first auger 26 into the ground and draw the elongated rod 12 downwardly into the ground. The second auger 28 will engage the ground and follow the path of the first auger 26 into the ground. Rotation will continue until the stabilizing plate 14 engages the ground. The cover 19 can then be slid over the top of the support member 16 and slid downward on the support member 16 until it covers the stabilizing plate 14. The satellite dish may be secured to the support member 16. The cover can be lifted to permit the installer access to an opening 34 in the stabilizing plate 14. The cable 22 may be inserted through the opening 34 in the stabilizing plate 14 and through the opening 24 in the bottom of the tubular support member 16 and drawn through the interior of the support member 16 for connection to the satellite dish. Then the cover 19 can be moved downwardly to a position engaging the ground and covering the stabilizing plate 14.

The two spaced apart augers 26 and 28 are designed to facilitate entry of the elongated rod 12 into the ground. The second auger 28 follows the path of the first auger 26 and hence passage in the ground is facilitated. The positioning of the two augers 26 and 28 on the elongated rod 12 help to stabilize the elongated rod 12 in the ground and thus stabilize the pole mount 10. Stabilization of the pole mount 10 in the ground is enhanced by the stabilizing plate 14, which engages the ground when the elongated rod 12 is pulled into the ground by the action of the two spaced apart augers 26 and 28.

In order to make it easier to handle and to ship the pole mount 10, the elongated rod 12 and/or the support member 16 may be separately fabricated and detachably secured to the stabilizing plate 14 by suitable connecting means. This can be accomplished in several ways. For example, as shown in FIG. 4, the connecting means may comprise an internally threaded cylinder connected to each side of the stabilizing plate 14 and extending outwardly therefrom. The cylinders 13 and 15 may be suitably secured to the stabilizing plate 14, for example, by welding. The lower end of the support member 16 and the upper end of the elongated rod 12 may be externally threaded and sized complementary to the internal diameter of the internally threaded cylinder 15 and 13, respectively. Thus, the elongated rod 12 and the support member 16 can be shipped in a kit with the other components of the pole mount 10 and then detachably secured to the cylinders 13,15, which are secured to the stabilizing plate 14, in the field. A set screw or lock screw 17 may be inserted through an opening in each cylinder 13, 15 for securing the elongated rod 12 and the support member 16 in place in the respective cylinder. It is not necessary to thread the ends of the support member and the elongated rod that engage with the cylinders. For example, smooth walled cylinders may be elongated and the ends of the support member and elongated rod may be inserted into the cylinders and secured in place by suitable fastening means, such as, set screws or lock screws.

While I have shown a presently preferred embodiment of the present invention, it will be apparent to persons skilled in the art that the invention may be otherwise embodied within the scope of the following claims.

I claim:

1. A pole mount for supporting a satellite dish comprising an elongated rod having a ground penetrating end, a first auger secured to the rod and spaced from the end, a second auger secured to the rod and spaced further from the end then the first auger, the second auger having a larger diameter than the first auger, the ratio of the diameter of the first auger with respect to the second auger being on the order of three to five, a stabilizing plate secured adjacent the top of the rod for engaging the ground, a tubular support member secured to the stabilizing plate and extending therefrom in a direction opposed to the elongated rod, said tubular support member having an opening in a portion thereof close to the stabilizing plate, and a cable constructed and arranged to be connected to the satellite dish, the cable extending through the opening in the tubular member whereby, in use, the rod is forced into the ground and upon rotation of the rod, the first auger will engage and pull the rod further into the ground and upon further rotation, the second auger will engage and help pull the rod into the ground until the stabilizing plate engages the ground surface, to firmly support the support member in an upright position without the need for any additional support.

2. A pole mount as in claim 1, including a cover constructed and arranged to extend over the stabilizing plate and the opening in the tubular member.

3. A pole mount as in claim 2, wherein the cover is generally conical in shape, with an opening in the apex thereof that is constructed and arranged to closely engage with the exterior of the tubular member.

4. A pole mount as in claim 2, wherein the stabilizing plate has an opening therein, whereby, the cable may extend from the ground through the opening in the stabilizing plate and through the opening in the tubular member to the satellite dish.

5. A pole mount as in claim 3, wherein the diameter of the bottom of the cover is greater than the stabilizing plate and entirely covers the stabilizing plate in use.

6. A pole mount as in claim 1, wherein the stabilizing plate has a notch therein extending inwardly from the perimeter of the stabilizing plate.

7. A pole mount for supporting a satellite dish comprising an elongated rod having a ground penetrating end, a first auger secured to the rod and spaced from the end, a second auger secured to the rod and spaced further from the end then the first auger, the second auger having a larger diameter than the first auger, the ratio of the diameter of the first auger with respect to the second auger being on the order of three to five, a generally planar stabilizing plate secured adjacent the top of the rod for engaging the ground, a tubular support member secured to the stabilizing plate and extending therefrom in a direction opposed to the elongated rod, said tubular support member having an opening therein adapted to receive a cable that is to be connected to the satellite dish, whereby, in use, the rod is forced into the ground and upon rotation of the rod, the first auger will engage and pull the rod further into the ground and upon further rotation, the second auger will engage and help pull the rod into the ground until the stabilizing plate engages the ground surface, to firmly support the tubular support member in an upright position without the need for any additional support.

8. A pole mount as in claim 7, wherein the first auger is closely spaced to the ground penetrating end of the elongated rod.

9. A pole mount as in claim 8, wherein the first auger is spaced about 1¼ inches from the end of the elongated rod.

10. A pole mount as in claim 9, wherein the second auger is spaced about 15 inches from the first auger.

11. A pole mount as in claim 10, wherein the elongated rod is about 24 inches long.

12. A pole mount as in claim 8, wherein the ratio of the distance from the ground penetrating end to the first auger with respect to the distance from the first auger to the second auger is on the order of 1 to 12.

13. A pole mount as in claim 1, wherein connecting means are provided for detachably securing either the support member or the elongated member to the stabilizing plate.

14. A pole mount as in claim 1, wherein connecting means provided for detachably securing the support plate and the elongated rod to the stabilizing member.

15. A pole mount as in claim 14, wherein the connecting means comprise cylinders secured to the stabilizing plate and extending in opposite directions from said stabilizing plate, the cylinders being constructed and arranged to receive the ends of the support member and the elongated rod, respectively.

16. A pole mount as in claim 15, wherein the cylinders are threaded and the elongated rod and the support member have complementary threads for engaging with the threads on the associated cylinder.

17. A pole mount as in claim 16, wherein fastening means are provided to secure the support member and the elongated rod to the respective cylinders.

* * * * *

UNITED STATES PATENT AND TRADEMARK OFFICE

CERTIFICATE OF CORRECTION

PATENT NO. : 6,328,273 B1
DATED : December 11, 2001
INVENTOR(S) : Christopher C. Kemikem It is certified that error appears in the above-identified patent and that said Letters Patent is hereby corrected as shown below:

Column 5,
Line 29, after "cable" insert -- within the tubular member --.
Line 37, after "support" insert -- whereby said cable is adapted to extend from said satellite dish through the tubular member and through said opening --

Signed and Sealed this

Tenth Day of February, 2004

JON W. DUDAS
*Acting Director of the United States Patent and Trademark Office*